US006334652B1

(12) United States Patent
Chen et al.

(10) Patent No.: US 6,334,652 B1
(45) Date of Patent: Jan. 1, 2002

(54) SEAT WITH ADJUSTABLE BACKREST

(75) Inventors: Er-Jui Chen, Feng-Shan; Ling-Chuan Chang, Chia-I; Cheng-Fan Yang, Tainan Hsien, all of (TW)

(73) Assignee: Link Treasure Limited, Tortola (VG)

( * ) Notice: Subject to any disclaimer, the term of this patent is extended or adjusted under 35 U.S.C. 154(b) by 0 days.

(21) Appl. No.: 09/642,212

(22) Filed: Aug. 17, 2000

(51) Int. Cl.[7] ..... A47D 1/00
(52) U.S. Cl. ..... 297/357; 297/256.13
(58) Field of Search ..... 297/256.1, 256.13, 297/357

(56) References Cited

U.S. PATENT DOCUMENTS 769,298 A * 9/1904 Boyer ..... 297/357 X
778,526 A * 12/1904 Bennett ..... 297/357 X
913,062 A * 2/1909 Sherman ..... 297/357
2,146,520 A * 2/1939 Zimtbaum ..... 297/357
3,019,028 A * 1/1962 Hedstrom ..... 297/357 X
3,656,728 A * 4/1972 Griggs ..... 297/357

* cited by examiner

*Primary Examiner*—Peter R. Brown
(74) *Attorney, Agent, or Firm*—W. Wayne Liauh

(57) ABSTRACT

A seat is configured to comprise a plurality of notches on the arm of seat portion and two shaped shrouds of backrest each covered on the arm. Whereby raising the shrouds will cause the shrouds to disengage from the notches so as to freely move above along the notches and release of the shrouds will cause the shrouds to move downward to engage with the notches. By utilizing this, an angle adjustment of backrest with respect to seat portion is effected.

15 Claims, 7 Drawing Sheets

SEAT WITH ADJUSTABLE BACKREST

BACKGROUND OF THE INVENTION

1. Field of Invention

The present invention relates to a seat and more particularly to an infant seat with angle adjustable backrest having the characteristics of simple components and convenient manipulation.

2. Related Art

Conventionally, an infant stroller is designed to provide a convenient transportability for parents in taking an infant out. Also, a highchair is designed to provide a convenient means to feed a baby by parents. Further, a swing is designed to provide an amusement to seated baby. In all above products, a seat for supporting infant is an indispensable component. In general, such seat comprises a seat portion and a backrest.

Further, typical seats are divided into seats with fixed backrest and seats with adjustable backrest. As to fixed backrest, seat portion and backrest are generally formed integrally such as by injection molding, or alternatively seat portion and backrest are separate pieces secured together by fasteners (e-g., screws, rivets). But an adjustable backrest is preferred for providing some degree of comfort to the seated person. A number of prior art mechanisms for adjusting backrest are found in a search such as Taiwanese Patent Publication Nos. 318,358 and 329,129 and U.S. Pat. No. 5,669,664. These prior art generally disclose a mechanism consisting a number of elements for adjusting the angle of backrest with respect to seat portion. For example, in above Taiwanese Patent Publication No. 318,358 and U.S. Pat. No. 5,669,664 both disclose the following characteristics: A plurality of notches are provided in each adjustable arm. The frame of adjustable arm is made of metal for enhancing the strength. Both adjustable arms are required to align precisely for effecting a cooperation each other. A positioning lever is releasably secured to one notch of either arm. Further, a control means provided in either seat portion or backrest is coupled to adjustable arm. Such control means is suitably located for providing a convenient manipulation of the angle adjustment of backrest for operator.

In view of above, adjustable arms, positioning levers, control means, and other associated elements are provided in such mechanism. Inevitably, it complicates the assembly procedure due to complex structure, resulting in an increase in the manufacturing cost. To the worse, its manipulation is not convenient.

Thus, it is desirable to provide an improved seat with adjustable backrest in order to overcome the above drawbacks of prior art.

SUMMARY OF THE INVENTION

It is therefore an object of the present invention to provide a seat with adjustable backrest. The seat consists of a seat portion and a backrest for supporting infant. The above and other objects of the present invention are realized by configuring a plurality of notches on the arm of seat portion and two shaped shrouds of backrest each covered on the arm, whereby raising the shrouds will cause the shrouds to disengage from the notches so as to freely move above along the notches and release of the shrouds will cause the shrouds to move downward to engage with the notches. By utilizing this, an angle adjustment of backrest with respect to seat portion is effected.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become fully understood from the detailed description given hereinbelow illustration only, and thus are not limitative of the present invention, and wherein.

DETAILED DESCRIPTION OF THE INVENTION

Figure 1:
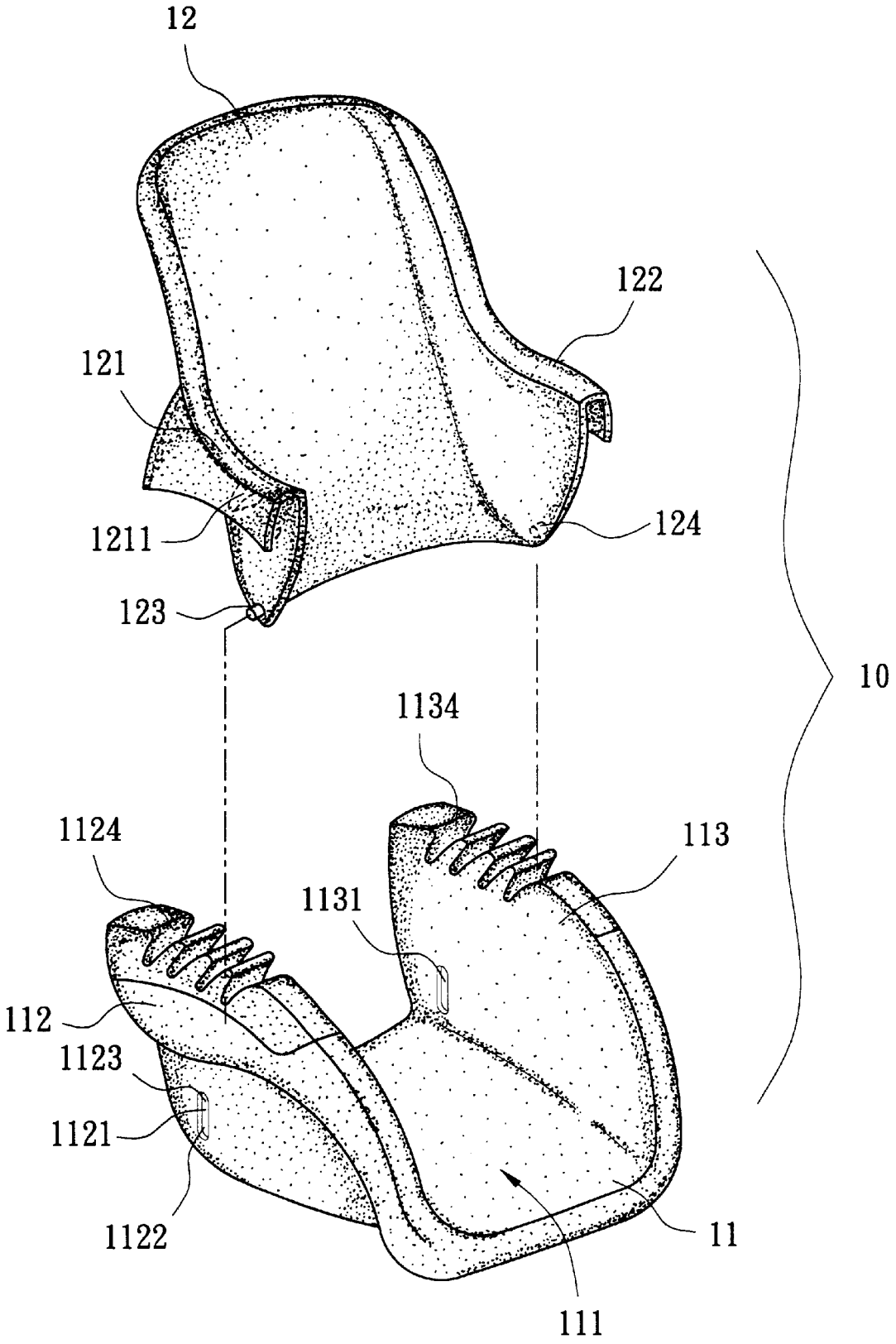
FIG. 1 is an exploded view of a seat incorporating an angle adjustable mechanism according to the invention.
Figure 2:
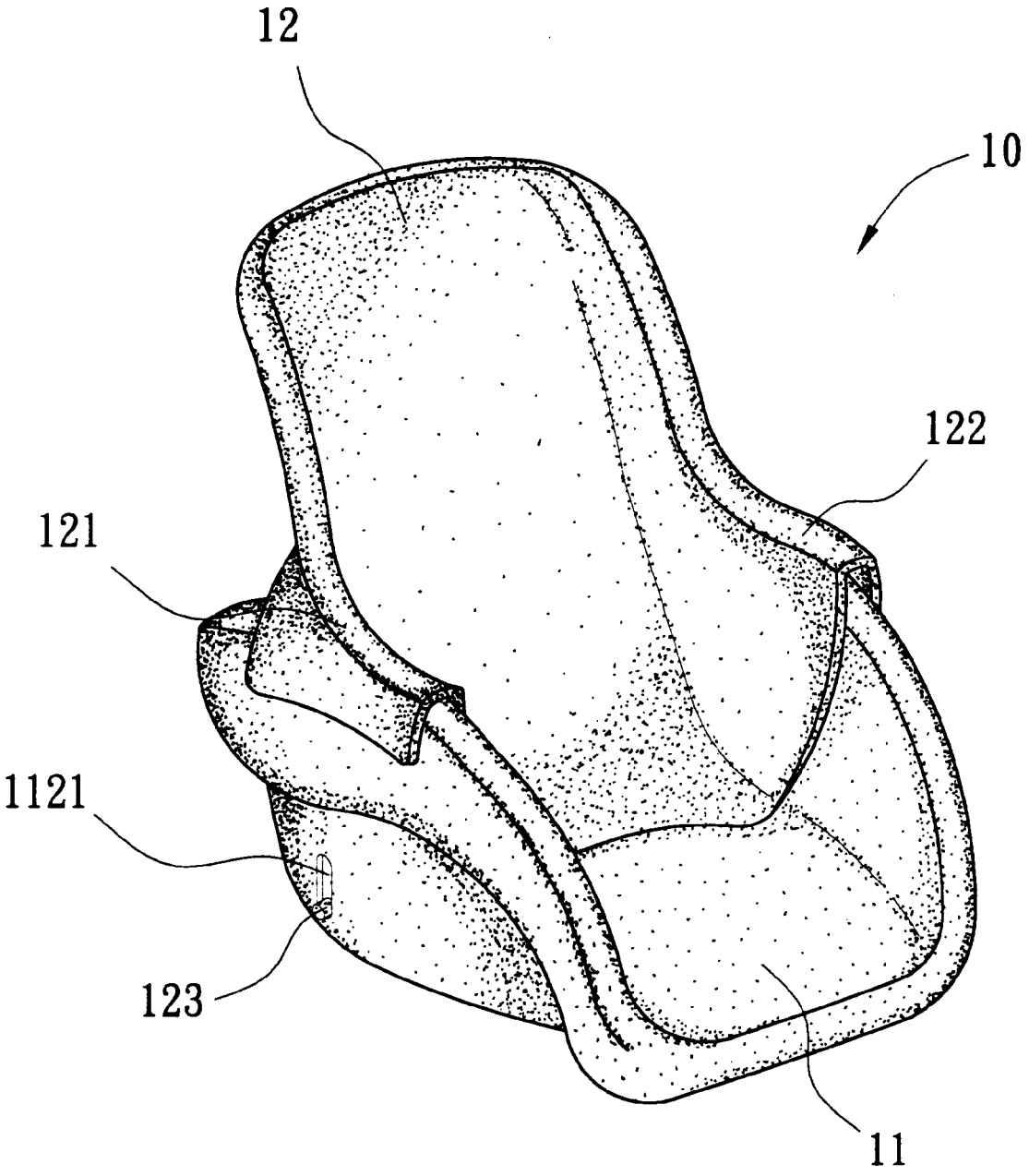
FIG. 2 is a perspective view of the assembled FIG. 1 seat.

Referring to FIGS. 1 and 2, there is shown a seat 10 consisting of seat portion 11 and backrest 12 incorporating an angle adjustable mechanism according to the invention. Seat portion 11 has a U cross-section to form a receiving space 111 for supporting an infant. Preferably, a soft fabric is covered on seat portion 11. Seat portion 11 further comprises two arms 112, 113 and two side longitudinal slots 1121, 1131 below arms 112, 113 near the bottom wherein longitudinal slot 1121 has a top position 1123 and a bottom position 1122. Note that since arm 113 is a mirror image of arm 112 such that a following detailed description of arm 112 is sufficient. Top surface of arm 112 is an arc with respect to the top position 1123 thereof. A plurality of notches 1124 is serially provided on the arm 112. As such, one notch 1124 has an angle with respect to the vertical line passing the top position 1123 different from that of the adjacent notch 1124.

Backrest 12 is movably attached to the rear of seat portion 11. Backrest 12 comprises two shaped shrouds 121, 122. Further, note that since shroud 122 is a mirror image of shroud 121 such that a following detailed description of shroud 121 is sufficient. Shroud 121 generally has an inverted U cross-section so as to cover on the arm 112. Shroud 121 comprises a projection 1211 on the underside sized to match notch 1124 and an outward extended stud 123 sized to slidably move within the longitudinal slot 1121.

In assembling adjust, simply put projections 1211 of shrouds 121, 122 onto predetermined notch 1124 of arm 112 and notch 1134 of arm 113 respectively. Then insert studs 123, 124 into longitudinal slots 1121, 1131 respectively. Thus, a complete seat 10 is assembled.

Figure 3A:
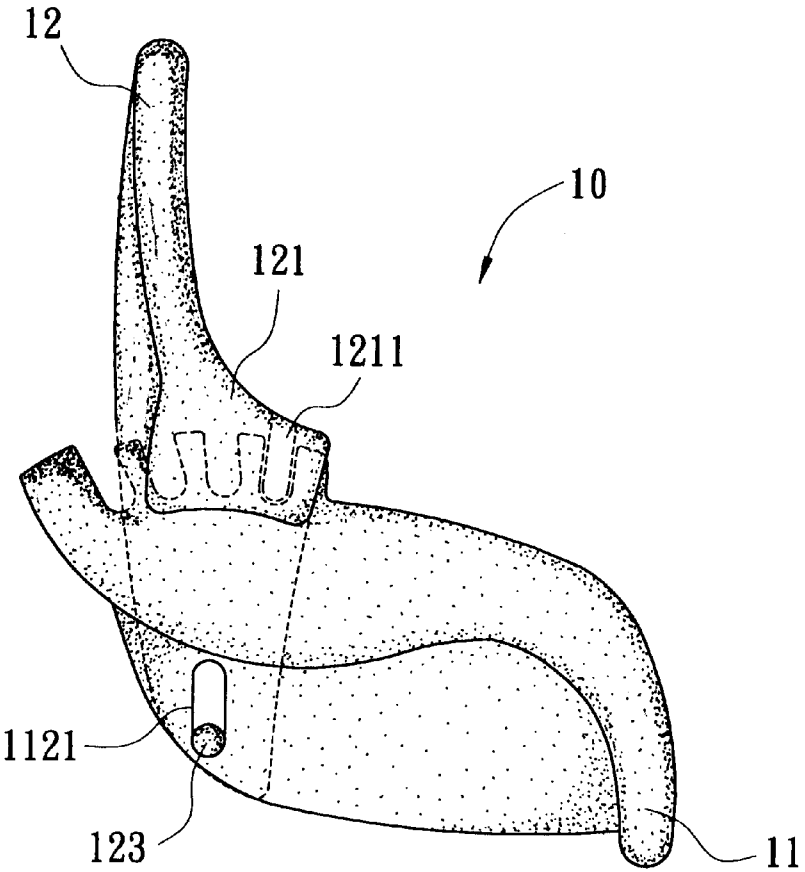
FIGS. 3A, 3B, and 3C schematically depict operations of the FIG. 1 seat.
Figure 3B:
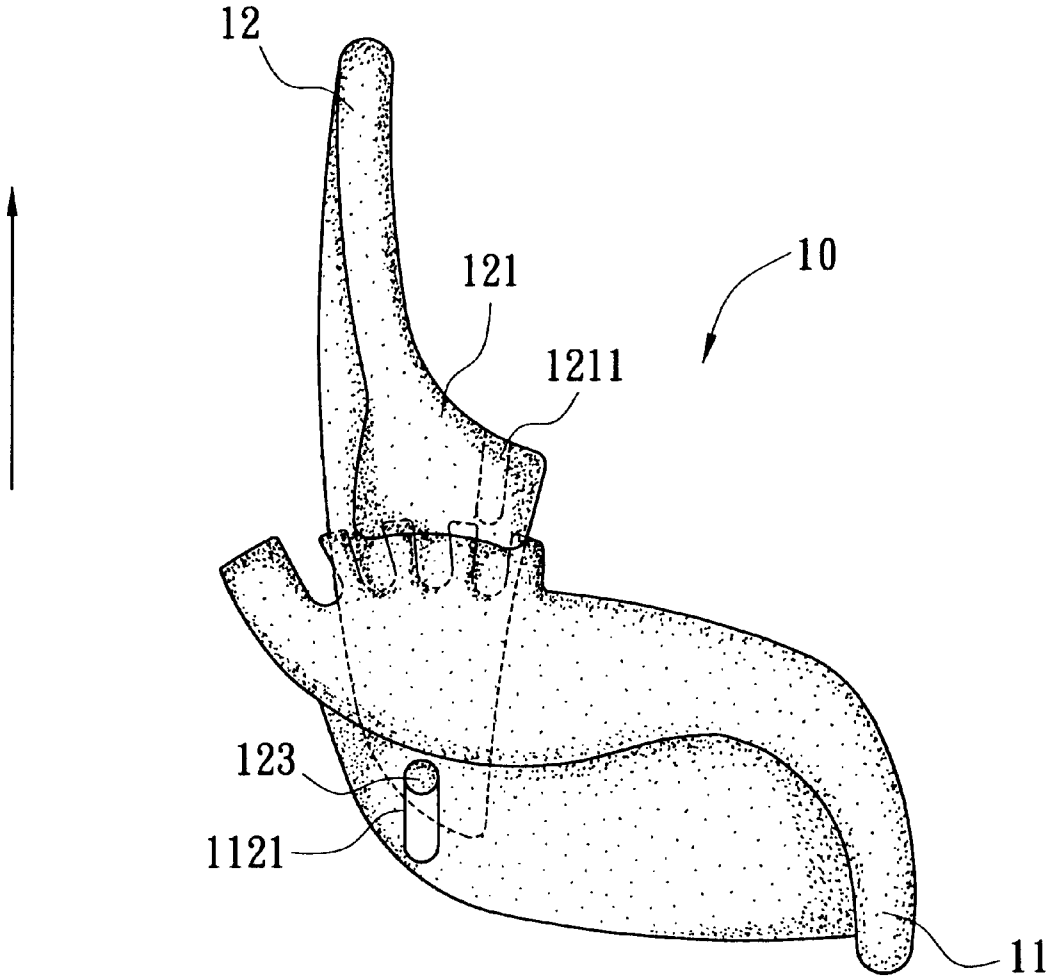
Figure 3C:
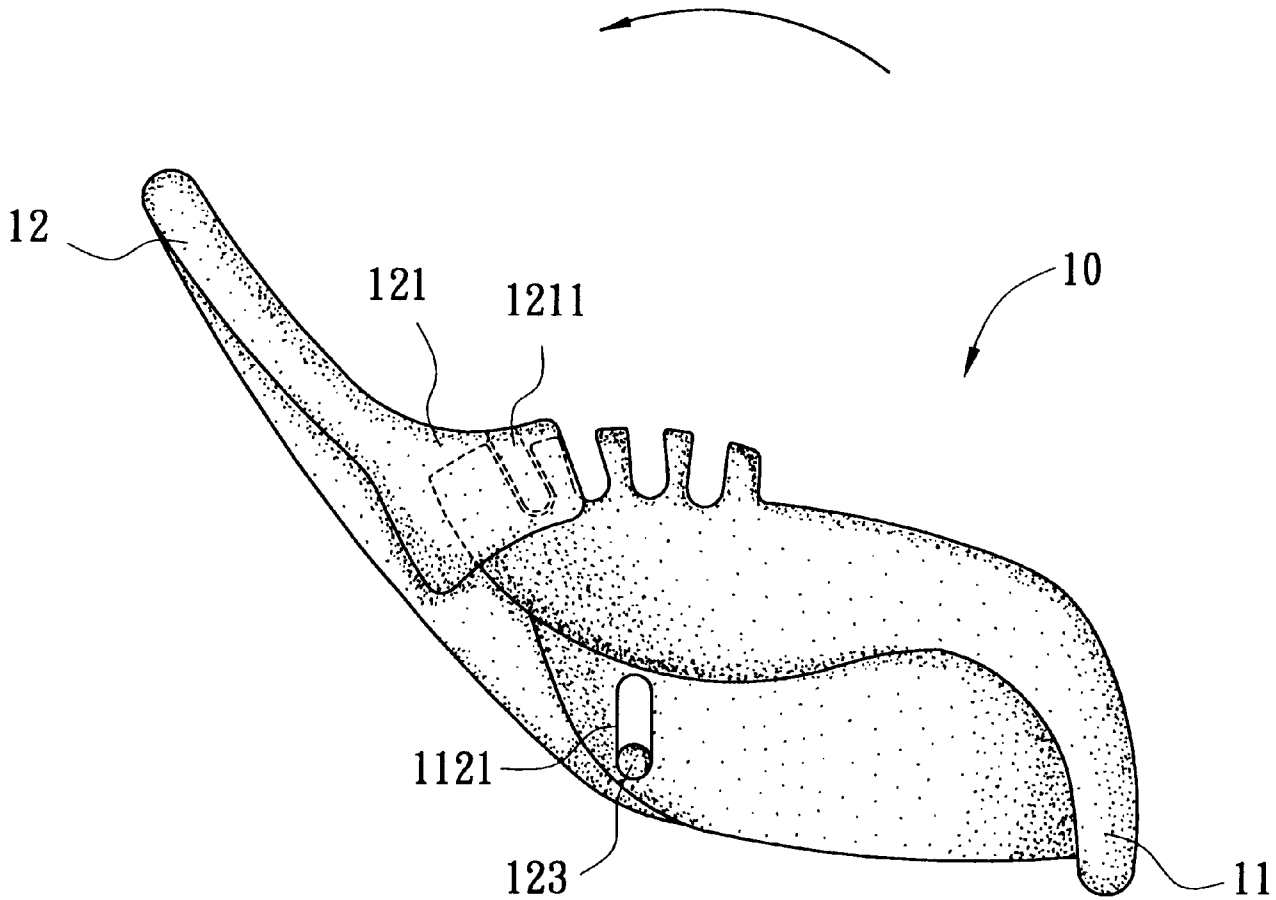

Referring to FIGS. 3A, 3B, and 3C, a detailed description of operations of the FIG. 2 seat 10 is as below.

In adjusting the relative positioning of backrest 11 with respect to seat portion 12, first in a locked position (FIG. 3A) raising the shrouds 121, 122 of seat 12 will cause the shrouds 121, 122 to disengage from the notch 1124 of arm 112 and notch 1134 of arm 113 respectively (i.e., studs 123, 124 changed from bottom position 1122 of FIG. 3A to top position 1123 of FIG. 3B). In this operating position (FIG. 3B), then freely move shrouds 121, 122 above along the notches 1124, 1134 until a desired angle of the backrest 11 is reached (i.e., projections 1211 aligned with that desired notches 1124, 1134). Next release the shrouds 121, 122 to cause projections 1211 to move downward to engage with the other notches 1124, 1134 of arms 112, 113 respectively to lock the backrest 11 to the seat portion 12 again (i.e., studs 123, 124 changed from top position 1123 of FIG. 3B to bottom position 1122 of FIG. 3C). As a result, an angle adjustable of backrest 11 with respect to seat portion 12 is effected.

Figure 4:
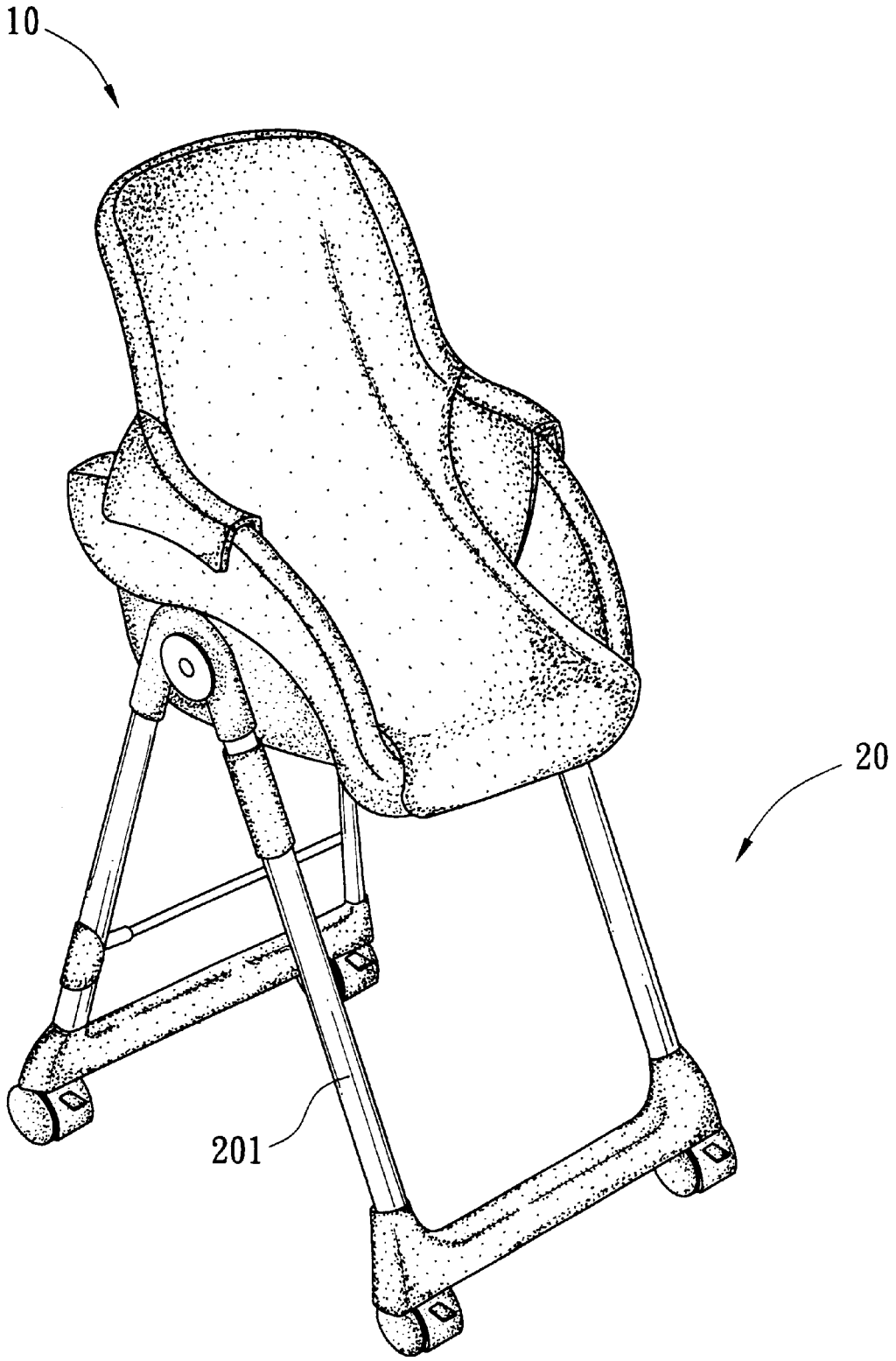
FIG. 4 is a perspective view of a highchair incorporating the angle adjustable mechanism according to the invention.

Referring to FIG. 4, there is shown an application of the mechanism of the invention on a highchair. As shown, seat 10 is mounted on a frame 20 for supporting infant. Frame 20 comprises a plurality of coupled tube members 201 to form an elevation for the seat 10.

Figure 5:
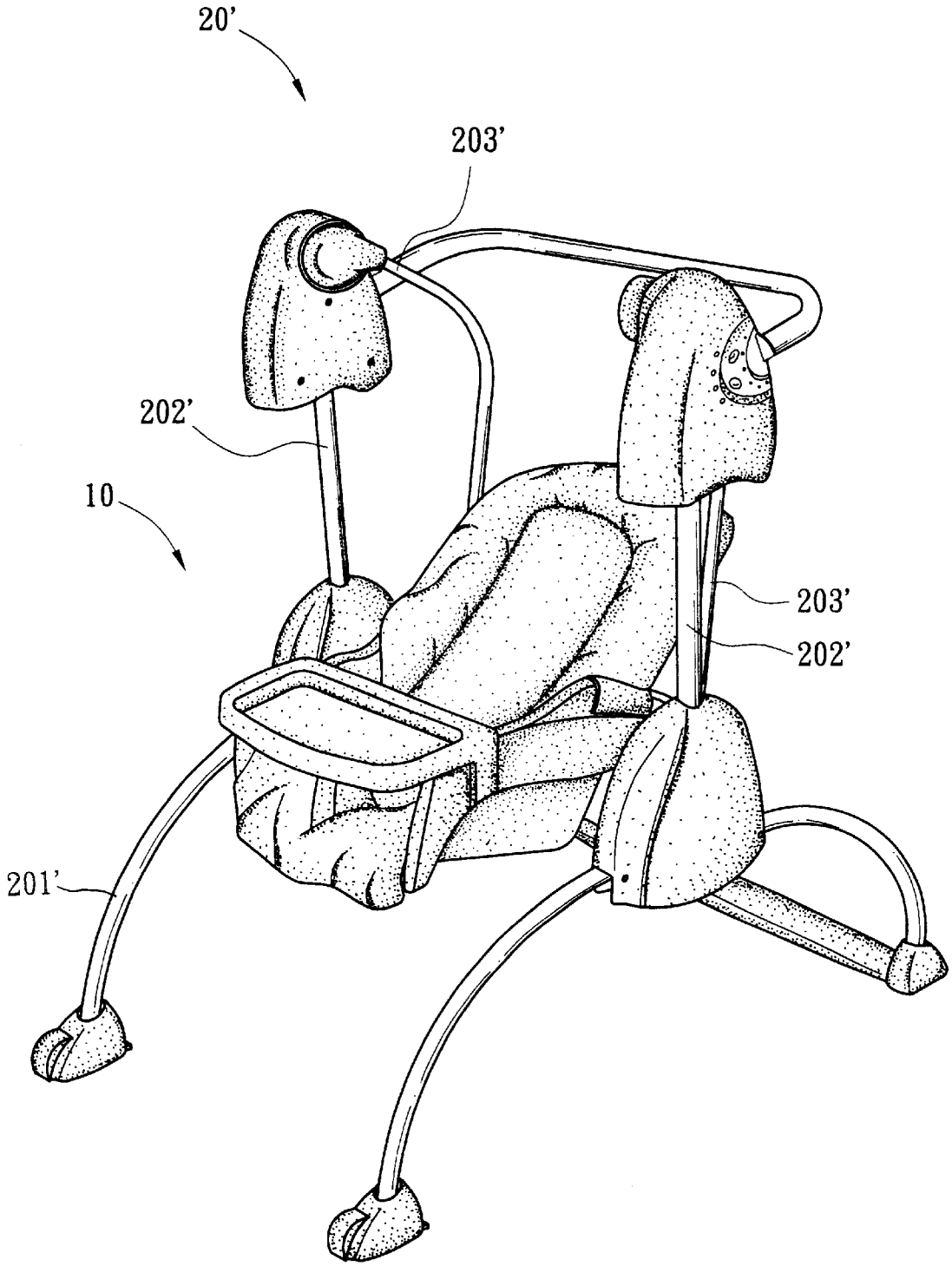
FIG. 5 is a perspective view of a swing incorporating the angle adjustable mechanism according to the invention.

Referring to FIG. 5, there is shown another application of the mechanism of the invention on a swing. As shown, seat 10 is mounted on a frame 20' for supporting infant. Frame 20' comprises a plurality of coupled tube members 201', two opposed uprights 202', and two brackets 203'. Each of the brackets 203' has one end pivotally coupled to the top end of the uprights 202' and the other end coupled to seat 10 so as to provide an amusement to the seated baby.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A seat supported by a frame including a plurality of tube members, the seat comprising:

a seat portion comprising a receiving space for supporting an infant and two arms each having a plurality of notches serially provided thereon; and a backrest movably attached to the seat portion, wherein said backrest comprises two side shaped shrouds each having an inverted U cross-section so as to cover on the arm, and two projections each beneath the shroud sized to match the notches, so as to allow said backrest to be disposed in a locked position with respect to one of the notches of the seat portion or in a free position with respect to the notches of the seat portion.

2. The seat of claim 1, wherein:

the seat portion further comprises two side longitudinal slots each having a bottom position and a top position.

3. The seat of claim 2, wherein the notches are formed in different angles with respect to the longitudinal slots so as to allow the backrest to assume a different tilt angle when the projections are engaged in different slots.

4. The seat of claim 2, wherein the backrest further comprises two extending studs to be respectively received in the side longitudinal slots to attach the backrest to the seat portion, each of the studs being removable between the bottom first position and the bottom position.

5. The seat of claim 1, further comprising a fabric covered on the seat portion.

6. A highchair comprising:

a seat for supporting an infant, including:

a seat portion comprising a receiving space and two arms each having a plurality of notches serially provided thereon;

a backrest movably attached to the seat portion, wherein said backrest comprises two side shaped shrouds each having an inverted U cross-section so as to cover on the arm, and two projections each beneath the shroud sized to match the notches, so as to allow said backrest to be disposed in a locked position with respect to one of the notches of the seat portion or in a free position with respect to the notches of the seat portion; and a frame including a plurality of coupled tube members to allow the seat to be in an elevated position.

7. The highchair of claim 6, wherein:

the seat portion further comprises two side longitudinal slots each having a bottom position and a top position.

8. The highchair of claim 7, wherein the notches are formed in different angles with respect to the longitudinal slots so as to allow the backrest to assume a different tilt angle when the projections are engaged in different slots.

9. The seat of claim 7, wherein the backrest further comprises two extending studs to be respectively received in the side longitudinal slots to attach the backrest to the seat portion, each of the studs being removable between the bottom first position and the bottom position.

10. The highchair of claim 6, further comprising a fabric covered on the seat portion.

11. A swing comprising:

a frame including a plurality of coupled tube members disposed on a supporting ground;

a seat for supporting an infant, including:

a seat portion comprising a receiving space and two arms each having a plurality of notches serially provided thereon;

a backrest movably attached to the seat portion, wherein said backrest comprises two side shaped shrouds each having an inverted U cross-section so as to cover on the arm, and two projections each beneath the shroud sized to match the notches, so as to allow said backrest to be disposed in a locked position with respect to one of the notches of the seat portion or in a free position with respect to the notches of the seat portion; and a pair of brackets each having one end pivotally coupled to the frame and the other end coupled to the seat portion.

12. The swing of claim 11, wherein:

the seat portion further comprises two side longitudinal slots each having a bottom position and a top position.

13. The swing of claim 12, wherein the notches are formed in different angles with respect to the longitudinal slots so as to allow the backrest to assume a different tilt angle when the projections are engaged in different slots.

14. The swing of claim 12, wherein the backrest further comprises two extending studs to be respectively received in the side longitudinal slots to attach the backrest to the seat portion, each of the studs being removable between the bottom first position and the bottom position.

15. The swing of claim 11, further comprising a fabric covered on the seat portion.

* * * * *